US009169108B2

(12) United States Patent
Tanizumi et al.

(10) Patent No.: US 9,169,108 B2
(45) Date of Patent: Oct. 27, 2015

(54) PERFORMANCE LINE DISPLAY UNIT

(75) Inventors: Kazuya Tanizumi, Kagawa (JP); Iwao Ishikawa, Kagawa (JP)

(73) Assignee: Tadano Ltd., Kagawa (JP)

( * ) Notice: Subject to any disclaimer, the term of this patent is extended or adjusted under 35 U.S.C. 154(b) by 0 days.

(21) Appl. No.: 13/544,191

(22) Filed: Jul. 9, 2012

(65) Prior Publication Data

US 2013/0013144 A1 Jan. 10, 2013

(30) Foreign Application Priority Data

Jul. 8, 2011 (JP) ..... 2011-151474

(51) Int. Cl.
*B66C 13/16* (2006.01)
*B66C 23/90* (2006.01)

(52) U.S. Cl.
CPC ..... *B66C 23/905* (2013.01)

(58) Field of Classification Search
None
See application file for complete search history.

(56) References Cited

U.S. PATENT DOCUMENTS

| | | | | |
|---|---|---|---|---|
| 5,217,126 | A * | 6/1993 | Hayashi et al. | 212/277 |
| 5,730,305 | A * | 3/1998 | Ichiba et al. | 212/276 |
| 5,823,370 | A * | 10/1998 | Ueda | 212/276 |
| 7,116,356 | B2 * | 10/2006 | Peeples | 348/207.99 |
| 2008/0309784 | A1 * | 12/2008 | Asari et al. | 348/222.1 |
| 2013/0345857 | A1 * | 12/2013 | Lee et al. | 700/229 |

FOREIGN PATENT DOCUMENTS

| | | | |
|---|---|---|---|
| CN | 201002925 | Y | 1/2008 |
| CN | 201148308 | Y | 11/2008 |
| JP | H03-115091 | A | 5/1991 |
| JP | H05-058589 | A | 3/1993 |
| JP | H5-147882 | A | 6/1993 |
| JP | H7-48088 | A | 2/1995 |
| JP | H07-137982 | A | 5/1995 |
| JP | 08-029917 | B | 3/1996 |
| JP | 2008-312004 | A | 12/2008 |

OTHER PUBLICATIONS

The extended European Search Report dated Oct. 10, 2012, which corresponds to European Patent Application No. 12174923.8-1256.
The first Office Action issued by the Chinese Patent Office on May 29, 2014, which corresponds to Chinese Patent Application No. 201210235808.9.
An Office Action; "Notice of Reasons for Rejection," issued by the Japanese Patent Office on Apr. 7, 2015, which corresponds to Japanese Patent Application No. 2011-151474.

* cited by examiner

*Primary Examiner* — Redhwan K Mawari
*Assistant Examiner* — Edward Torchinsky
(74) *Attorney, Agent, or Firm* — Studebaker & Brackett PC

(57) ABSTRACT

A performance line display unit includes an imaging device which is attached near a leading end of an extensible boom provided on a rotation platform rotatably placed on a vehicle of a crane, a display configured to display an image imaged by the imaging device, and a performance line arithmetic part configured to obtain a performance line regarding a suspended load maximum performance of a crane, wherein the performance line arithmetic part is configured to overlap the performance line with a position of the image corresponding to the obtained performance line to be displayed on the display.

8 Claims, 11 Drawing Sheets

PERFORMANCE LINE DISPLAY UNIT

PRIORITY CLAIM

The present application is based on and claims priority from Japanese Patent Application No. 2011-151474, filed on Jul. 8, 2011, the disclosure of which is hereby incorporated by reference in its entirety.

BACKGROUND

1. Field of the Invention

The present invention relates to a performance line display unit which displays an image photographed by an imaging device attached near the leading end of a boom of a crane with a performance line of a crane overlapped.

2. Description of the Related Art

A camera system is conventionally known, which overlaps a guide line illustrating a moving range of a leading end portion of a boom on an image photographed by a camera provided to photograph a periphery of a crane and displays its image (refer to Japanese Patent Application Publication No. 2008-312004).

A safety mechanism for a crane is also known, which displays on a display a stable zone and unstable zone with a rotation axis position of a boom as a center (refer to Japanese Patent Application Publication No. H08-29917).

The above-described camera system is configured to obtain a radius of a circle provided by the leading end portion of the boom in the rotation movement at a derricking angle with the present length of the boom, obtain the position of the circle on the world coordinate system based on the radius, projection-transform the position of the circle to the coordinate system of the imaging surface of the camera, overlap the transformed circle on the photographed image of the display as a guide line, and display its image.

A range closer to the crane than the guide line displayed on the display is a safe condition range. An operator rotates the boom while carefully watching whether or not an obstacle is in the safe condition range.

The above-described safety mechanism for a crane is configured to display on a display screen a rotation axis of a crane, a rectangular frame illustrating a crane, a position of each outrigger jack and an operation limit range according to each suspended load W.

However, the above-described camera system has a problem in that it can not determine how far a suspended load can be moved within the operation limit range of the crane if the boom is extended and the derricking angle is reduced because the above-described camera system can only display the moving range of the suspended load at the present derricking angle in the present length of the boom.

Moreover, the above-described safety mechanism for a crane also has a problem in that it can not determine how much the suspended load can be moved on the actually photographed image because the safety mechanism can only display on a display screen only the rotation axis position of a crane, the rectangular frame illustrating a crane and the operation limit line with the rotation axis position as a center.

SUMMARY

It is, therefore, an object of the present invention to provide a performance line display unit by which one can confirm how much a suspended load can be moved on a photographed image.

In order to achieve the above object, one embodiment of the present invention provides a performance line display unit including an imaging device which is attached near a leading end of an extensible boom provided on a rotation platform rotatably placed on a vehicle of a crane, a display configured to display an image imaged by the imaging device, and a performance line arithmetic part configured to obtain a performance line regarding a suspended load maximum performance of a crane, wherein the performance line arithmetic part is configured to overlap the performance line with a position of the image corresponding to the obtained performance line to be displayed on the display.

One embodiment of the present invention also provides a performance line display unit including an imaging device which is attached near a leading end of an extensible boom provided on a rotation platform rotatably placed on a vehicle of a crane, a display device including a display configured to display a graphic image illustrating a limit performance line with a rotation center of the crane as an original point, an imaging range detector configured to obtain an imaging range of the imaging device, and a limit performance line detector configured to obtain a position of the limit performance line, wherein the imaging range detector is configured to overlap an imaging frame illustrating the obtained imaging range with a portion of the graphic image corresponding to the imaging range to be displayed on the display, the display device is configured to display the image by the imaging device in a position of the display difference from that of the graphic image, and the limit performance line position detector is configured to obtain the position of the limit performance line in the imaging frame overlapped with the graphic image, and overlap the limit performance line with the position of the image corresponding to the obtained position to be displayed.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DESCRIPTION OF THE PREFERRED EMBODIMENT

Hereinafter, embodiments of a performance line display unit will be described with reference to the drawings.

Embodiment 1

Figure 1:
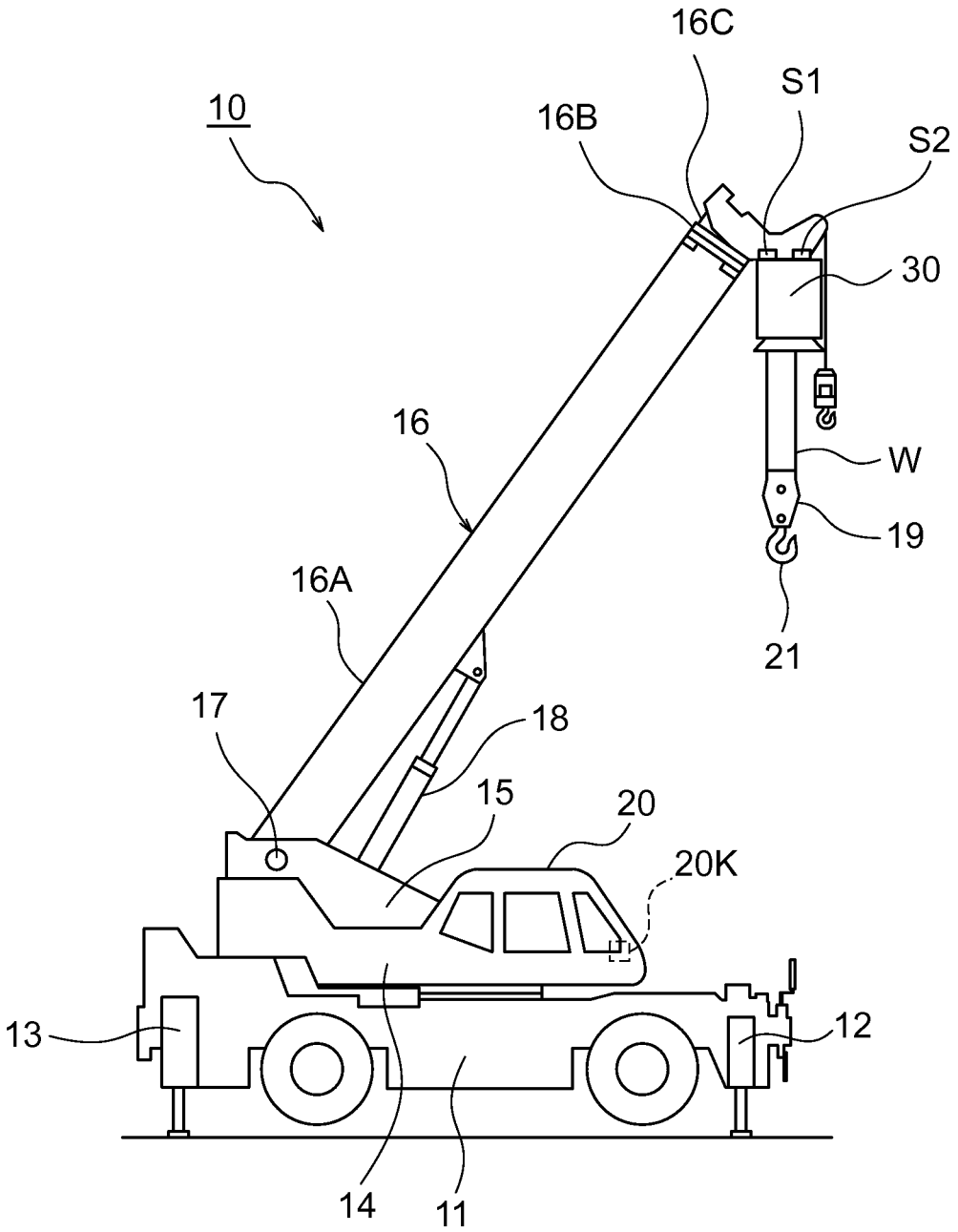
FIG. 1 is a side view illustrating a mobile crane equipped with a performance line display unit according to an embodiment of the present invention.

FIG. 1 illustrates a rough terrain crane 10 as a crane equipped with a performance line display unit. This rough terrain crane 10 includes a carrier 11 as a main body of a vehicle having a running operation, a pair of front outriggers 12 provided on the right and left of the front side of the carrier 11, a pair of back outriggers 13 provided on the right and left of the back side of the carrier 11, a rotation platform 14 attached on the carrier 11 in a horizontally rotatable manner, a cabin 20 provided in the rotation platform 14 and an extensible boom 16 attached to a bracket 15 fastened to the rotation platform 14.

The base end section of the extensible boom 16 is attached to the bracket 15 via a supporting shaft 17. The extensible boom 16 can be raised and lowered about the supporting shaft 17. A cylinder 18 for raising and lowering the extensible boom is provided between the bracket 15 and the extensible boom 16. The extensible boom 16 is raised and lowered by the expansion and contraction of the cylinder 18.

The extensible boom 16 includes a base boom 16A, intermediate boom 16B and leading end boom 16C. These are combined in the base boom 16A in order as a nesting structure. The extensible boom 16 extends and contracts by a not shown extensible cylinder.

A not shown sheave is provided in the leading end portion of the leading end boom 16C. A wire W is wound around the sheave, and a hook block 19 is suspended by this wire W. A hook 21 is attached to the hook block 19.

The wire W is wound and fed by a not shown winch. A suspended load-monitoring camera (imaging device) 30 such as a TV camera is attached to the leading end portion of the leading end boom 16C to face just below. This suspended load-monitoring camera 30 is able to tilt at a free angle relative to the vertical axis line in the pan and tilt directions. The suspended load-monitoring camera 30 is titled by an operation section 20K provided in the cabin 20. The tilt angle of the suspended load-monitoring camera 30 is detected by a tilt angle detection sensor S1 and pan angle detection sensor S2.

Figure 2A:
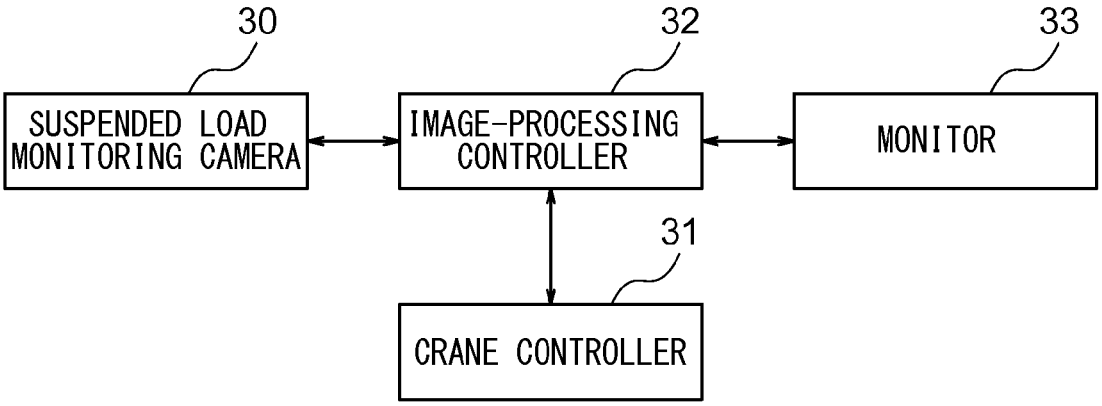
FIG. 2A is a block diagram illustrating a constitution of the performance line display unit.
Figure 2B:
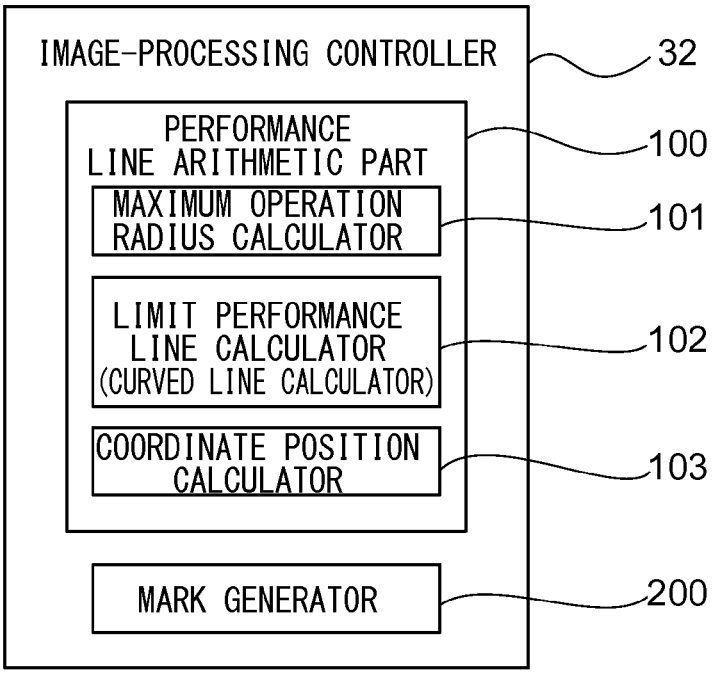
FIG. 2B is a block diagram illustrating a constitution of an image-processing controller illustrated in FIG. 2A.

FIG. 2A is a block diagram illustrating the constitution of the control system of the rough terrain crane 10. In FIG. 2A, reference number 31 is a crane controller. The crane controller 31 controls the projection amount of each outrigger 12, 13, the rotation of the rotation platform 14, the extension and contraction of the extensible boom 16, the raising and lowering of the extensible boom 16, or the like based on the operation of an operation section 20K provided in the cabin 20 illustrated in FIG. 1.

In FIG. 2A, reference number 32 is an image processing controller. This image processing controller 32 includes a performance line arithmetic part 100 which obtains a limit performance line illustrating a range in which the leading end portion of the extensible boom 16 can move and another performance line based on an actual load obtained by the crane controller 31 when the crane 10 suspends a load, and a mark generator 200 which generates a mark M (refer to FIGS. 3A-3C) illustrating a position of the ground which is just below the hook 21 of the crane 10.

The performance line arithmetic part 100 includes a maximum operation radius calculator 101 which obtains the maximum operation radius with the rotation axis of the extensible boom 16 as a center, a limit performance line calculator 102 which obtains a limit performance line as a border line which is a range of the maximum operation radius about the center, and a coordinate position calculator 103 which obtains coordinates of each position of an image imaged by the suspended load-monitoring camera 30.

The limit performance line illustrates the range of the maximum operation radius with the rotation axis of the extensible boom 16 as a center.

When the crane 10 does not suspend a load, the performance line arithmetic part 100 of the image-processing controller 32 obtains the maximum operation radius of a suspended load movable range with the length of the extensible boom 16 obtained by the crane controller 31, obtains the curved line illustrating the range of the maximum operation radius as a performance line and obtains the maximum operation radius in the input virtual load and the curved line illustrating the range of the maximum operation radius as a performance line. The virtual load is input by the key operation of an operation section 20K provided in the cabin 20.

The performance line of the crane 10 illustrates a range of a constant rate relative to the suspended load limit performance line of the crane 10 as a line, and includes a line in addition to the lines described above.

The crane controller 31 calculates an actual suspended load based on a cylinder pressure detected by a not shown pressure sensor of a derricking cylinder, a boom derricking angle and a boom length.

The image-processing controller 32 overlaps the limit performance line and the performance line obtained by the performance line arithmetic part 100 on the image imaged by the suspended load-monitoring camera 30 to be displayed on a screen (display section) 33A (refer to FIG. 3) of the monitor 33.

The performance line display unit includes the suspended load-monitoring camera 30, the image-processing controller 32 and the monitor 33.

[Operation]

Next, the operation of the performance line display unit constituted as described above will be described.

[When a Crane Suspends a Load]

At first, the case when the rough terrain crane 10 suspends a load will be described.

Figure 3A:
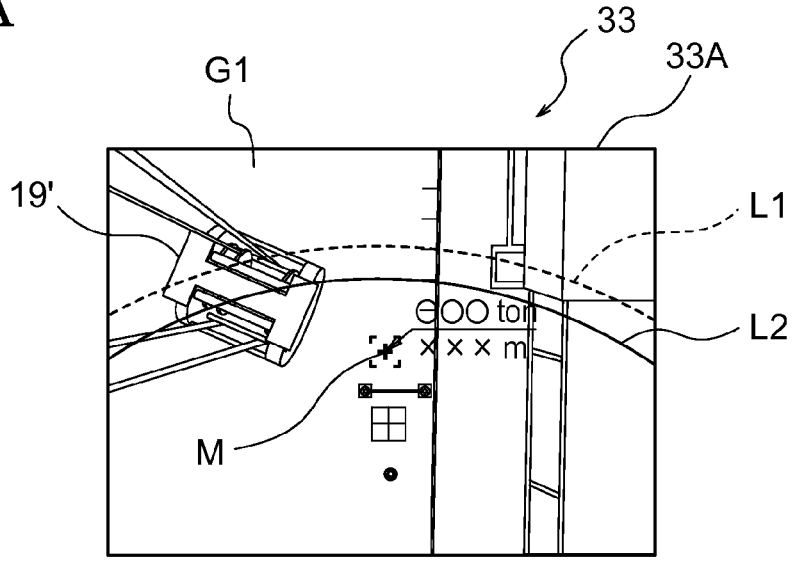
FIG. 3A is a view describing an image displayed on a monitor in which a limit performance line is overlapped with an image.

When a load is suspended, the crane controller 31 of the rough terrain crane 10 obtains an actual suspended load. The suspended load-monitoring camera 30 images from above the hook block 19 suspending a load. An image G1 is displayed on the screen 33A of the monitor 33 as illustrated in FIG. 3A.

The maximum operation radius calculator 101 of the performance line arithmetic part 100 of the image-processing controller 32 obtains the maximum operation radius with the rotation axis of the extensible boom 16 as a center based on the actual load obtained by the crane controller 31 and the projection amount of each of the outriggers 12, 13 detected by a not shown outrigger sensor. The limit performance line calculator 102 of the performance line arithmetic part 100 obtains a curved line (border line) illustrating the range of the maximum operation radius as a limit performance line L1 from the obtained maximum operation radius. The position of the limit performance line L1 is obtained with the rotation axis as an original point.

Namely, the limit performance line calculator 102 obtains the curved line (border line) illustrating the range of the maximum operation radius as the limit performance line L1.

The coordinate position calculator 103 of the image-processing controller 32 obtains each position (coordinate position) of a range of the ground imaged with the rotation axis as an original point based on a zooming magnification, tilt and pan, and a position of a height of the suspended load-monitoring camera 30. The position of the height of the suspended load-monitoring camera 30 is obtained based on the derricking angle and the length of the extensible boom 16 obtained by the crane controller 31. The length of the extensible boom 16 is obtained by the crane controller 31 based on the detection output detected by a not shown boom length sensor. The derricking angle of the extensible boom 16 is obtained by the crane controller 31 based on the output detected by a not shown boom angle sensor.

As illustrated in FIG. 3A, the image-processing controller 32 overlaps the obtained limit performance line L1 with the position of the corresponding image G1 to be displayed. Namely, the position of the limit performance line L1 obtained by the limit performance line calculator 102 is brought in line with the coordinate position of the image G1 obtained by the coordinate position calculator 103, so that the limit performance line L1 is overlapped with the image G1 to be displayed. The limit performance line L1 is displayed by a red line, for example. The screen 33A displays a value of an actual load and a value of the maximum operation radius. Moreover, an actual load ratio in a present operation posture can be displayed instead of the value of the actual load. In addition, reference number 19' denotes a hook block image.

As described above, since the image G1 displayed on the screen 33A of the monitor 33 is an actual image, the actual position of the limit performance line L1 can be confirmed, and an actual movable range of a suspended load can be confirmed. Therefore, the operation of the extensible boom 16 can be easily performed.

Moreover, it can be confirmed whether the suspended load can be moved to a target position or not.

The performance line arithmetic part 100 of the image-processing controller 32 obtains a performance line L2 of a 90% load rate (actual load/maximum load which can be suspended by present length of boom at a predetermined safe rate), and overlaps the performance line L2 on the image G1 to be displayed similar to the above. The performance line L2 is displayed by a yellow line, for example. The safe range is clarified by the display of the performance line L2, so that the extensible boom 16 can be easily operated.

For example, the actual suspended load, the present length of the extensible boom 16 and the cross shape mark M illustrating a position on the ground just below the hook 21 (refer to FIG. 1) are displayed on the screen 33A of the monitor 33 in addition to the performance lines L1, L2. The position on the ground just below the hook is obtained by the crane controller 31 based on the derricking angle and the present length of the boom and the rotation angle of the rotation platform 14. The cross shape mark M generated by the mark generator 200 is overlapped with the position of the image G1 corresponding to the obtained position to be displayed. Accordingly, the extensible boom 16 can be further easily operated.

Figure 3B:
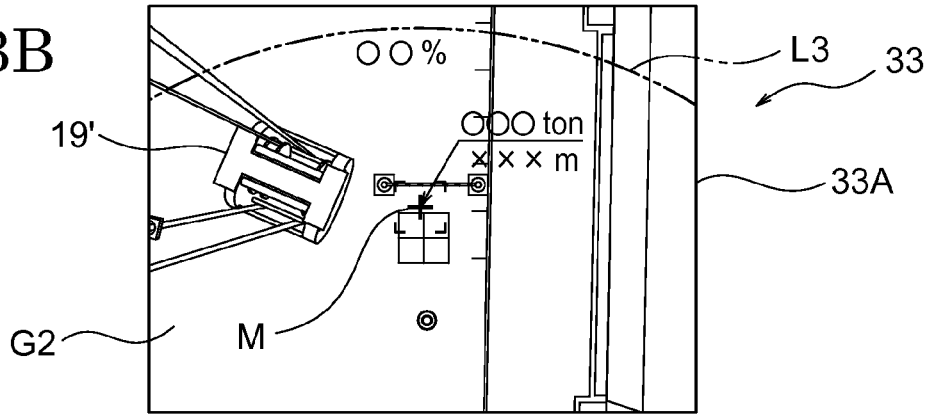
FIG. 3B is a view describing a performance line illustrating the maximum operation radius which can be displayed on the image.
Figure 3C:
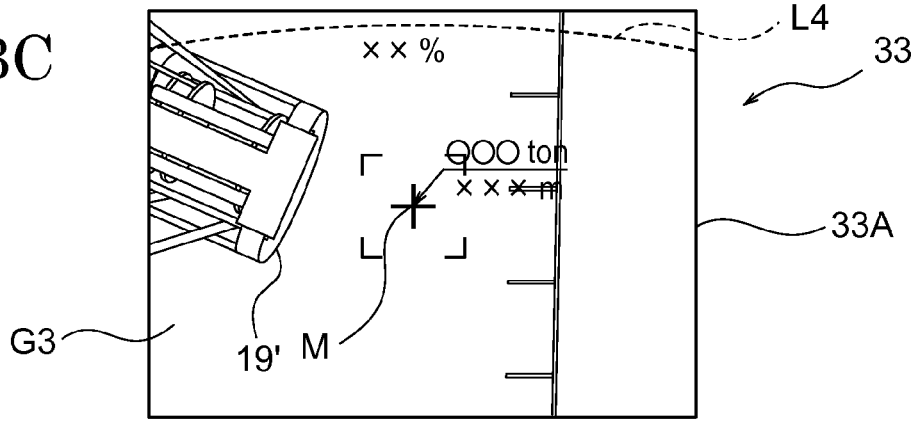
FIG. 3C is a view describing a performance chart illustrating the maximum operation radius which can be displayed on the image in zooming.

When the limit performance line L1 is not displayed on the screen 33A of the monitor 33 due to the derricking angle of the extensible boom 16 and the zooming magnification of the suspended load-monitoring camera 30, namely, when the limit performance line L1 is positioned outside the screen 33A of the monitor 33, the performance line arithmetic part 100 displays on the screen 33A as performance lines L3, L4 an operation radius which can be displayed on images G2, G3 in the screen 33A (a radius having contact with an image frame slightly smaller than the maximum image which can be displayed on the monitor 33) as illustrated in FIGS. 3B, 3C, and also displays the load ratio of the performance lines L3, L4. If the load ratio of the performance lines L3, L4 is less than 90%, for example, the performance lines are displayed by a green line.

When the screen 33A of the monitor 33 is expanded or the suspended load-monitoring camera 30 is panned or tilted, even if the limit performance line L1 is not displayed on the screen 33A, the performance lines L3, L4 are displayed, so that the condition of the performance lines L3, L4 of the suspended load can be confirmed.

[When a Crane does not Suspend a Load]

When the rough terrain crane 10 does not suspend a load, the maximum operation radius calculator 101 of the image-processing controller 32 obtains the maximum operation radius with the rotation axis as a center by the present length of the extendible boom 16, and the limit performance line calculator (curved line calculator) 102 obtains the circle (border line) of the maximum operation radius as a performance line L5. The position of the performance line L5 is obtained with the rotation axis as an original point similar to the above. The suspended load-monitoring camera 30 images the hook block 19 from above, and an image G4 is displayed on the screen 33A of the monitor 33 as illustrated in FIG. 4A.

Figure 4A:
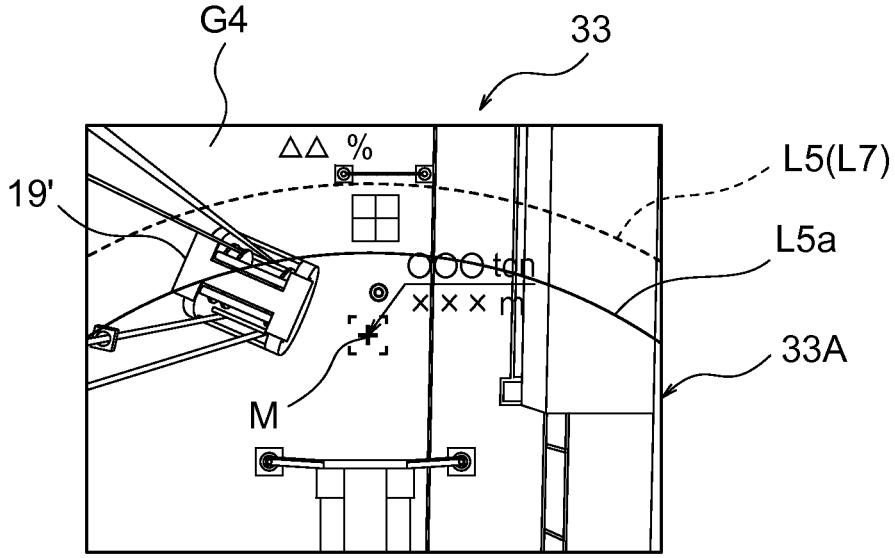
FIG. 4A is a view describing an image displayed on a monitor in which a performance line of the maximum operation radius is overlapped with an image.

The image-processing controller 32 brings the position of the performance line L5 obtained by the limit performance line calculator 102 in line with the coordinate position of the image G4 obtained by the coordinate position calculator 103, and overlaps the performance line L5 on the image G4 to be displayed on the screen 33A of the monitor 33 as illustrated in FIG. 4A. In this case, the performance line L5 is displayed by a red line, for example, and the maximum operation radius value and the maximum load value which can be suspended by the maximum operation radius are displayed.

The performance line arithmetic part 100 of the image-processing controller 32 obtains a performance line L5*a* of a 90% load rate in the maximum load, and displays the performance line L5*a* similar to the above.

An operator can confirm a movable range of a suspended load before a load is suspended by the image G4 and the performance line L5 displayed on the screen 33A of the monitor 33, and also confirm how much the suspended load can be actually moved because the image G4 is an actual image.

When the performance line L5 is not displayed on the screen 33A of the monitor 30 due to the derricking angle of the extensible boom 16 and the zooming magnification of the suspended load-monitoring camera 30, the performance line arithmetic part 100 of the image-processing controller 32 overlaps the operation radius which can be displayed on the image G5 in the screen 33A (a radius having contact with an image frame slightly smaller than the maximum image which can be displayed on the monitor 33) with the image G5 as a performance line L6 to be displayed, and displays the load rate of the performance line L6. If the load rate of the performance line L6 is less than 90%, for example, the performance line L6 is displayed by a green line. In this case, the above-described maximum operation radius and the maximum load value which can be suspended by the maximum operation radius are also displayed.

For this reason, when the screen 33A of the monitor 33 is expanded and the suspended load-monitoring camera 30 is panned and tilted, even if the performance line L5 is not displayed on the screen 33A, the performance line L6 is displayed, so that the condition of the performance line L6 of the suspended load can be confirmed before suspending a load.

Figure 4B:
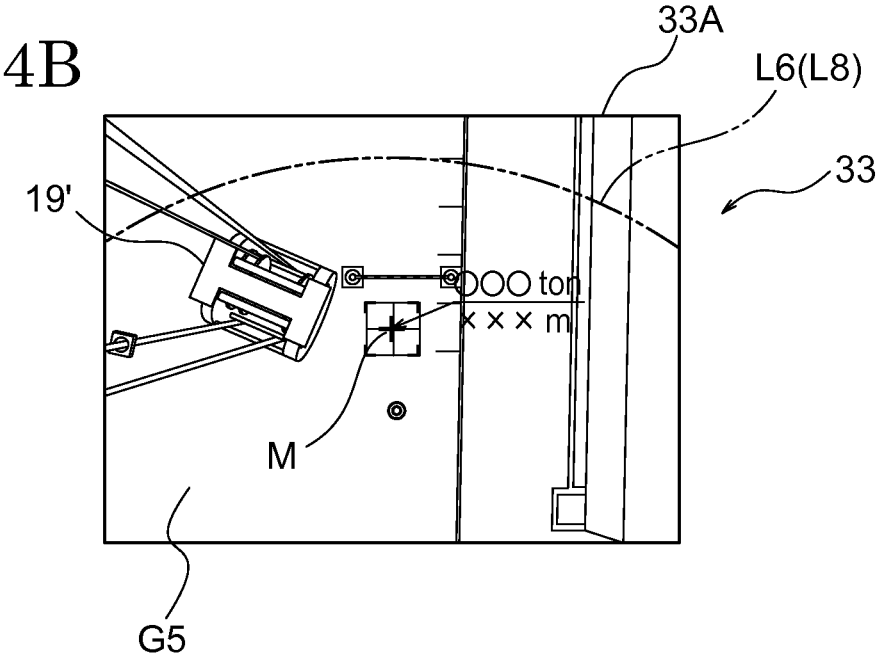
FIG. 4B is a view describing a performance line illustrating the maximum operation radius which can be displayed on the image.

In addition, in the display illustrated in FIG. 4B, the operation radius which can be displayed on the screen 33 and the maximum load which can be suspended by the operation radius can be displayed.

[Input of Virtual Load]

When a crane does not suspends a load, if a virtual load is input by operating the operation section 20K (refer to FIG. 1) provided in the cabin 20, the maximum operation radius calculator 101 of the performance line arithmetic part 100 of the image-processing controller 32 obtains the maximum operation radius in the virtual load.

Namely, the maximum operation radius calculator 101 obtains the maximum operation radius with the rotation axis of the extensible boom 16 as a center based on the input virtual load and the projection amount of each of the outriggers 12, 13 detected by the outrigger sensor obtained by the crane controller 31. The limit performance line calculator 102 obtains the curved line (border line) illustrating the range of the maximum operation radius from the obtained maximum operation radius as a limit performance line L7. The position of the limit performance line L7 is obtained with the rotation axis as an original point.

The performance line arithmetic part 100 of the image-processing controller 32 brings the position of the limit performance line L7 obtained by the limit performance line calculator 102 in line with the coordinate position of the image G4 obtained by the coordinate position calculator 103, and the overlaps the limit performance line L7 with the image G4 to be displayed on the screen 33A of the monitor 33 as illustrated in FIG. 4A.

An operator can confirm an actual moving range of a suspended load without suspending a load from the image G4 and the performance line L7 displayed on the screen 33A of the monitor 33.

When the limit performance line L7 is not displayed on the screen 33A of the monitor 33 due to the derricking angle of the extensible boom 36 and the zooming magnification of the suspended load-monitoring camera 30, the performance line arithmetic part 100 displays the operation radius which can be displayed in the screen 33A (a radius having contact with an image frame slightly smaller than the maximum image which can be displayed on the monitor 33) as the performance line L8 as illustrated in FIG. 4B, and also displays the load ratio of the performance line L8.

Therefore, when the screen 33A of the monitor 33 is expanded or the suspended load-monitoring camera 30 is panned or tilted, even if the limit performance line L7 is not displayed on the screen 33A, the performance line L8 is displayed, so that the condition of the performance line L8 of the suspended load can be confirmed before suspending a load.

Embodiment 2

Figure 5:
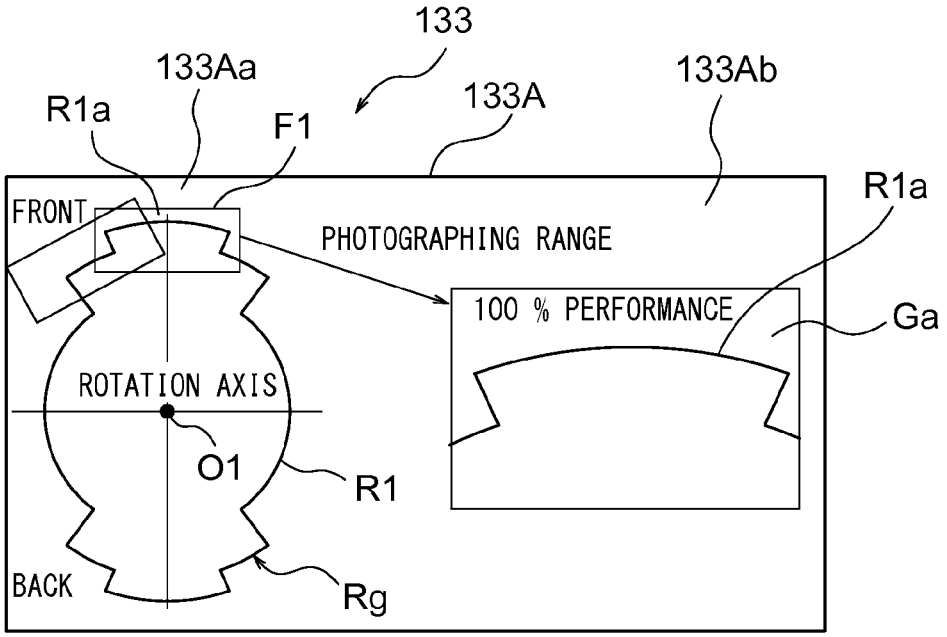
FIG. 5 is a view illustrating a screen of a monitor according to Embodiment 2.

FIG. 5 illustrates a screen (display) 133A of a monitor (display unit) 133 according to Embodiment 2. FIG. 9B is a block diagram illustrating a constitution of a control system according to Embodiment 2.

In this Embodiment 2, an image-processing controller 300 includes a performance line arithmetic part 400.

The performance line arithmetic part 400 includes a maximum operation radius calculator 401 which obtains the maximum operation radius in an actual load based on the actual load and the projection amount of each of the outriggers 12, 13, a limit performance line calculator 402 which obtains a limit performance line R1 illustrating the range of the maximum operation radius obtained by the maximum operation radius calculator 401, a graphic image generator 403 which generates a graphic image Rg illustrating the limit performance line R1 with the rotation axis O1 of the crane 10 as an original point, an imaging range detector 404 which obtains an imaging range imaged by the suspended load-monitoring camera 30, a limit performance line position detector 405 which obtains a position of a limit performance line in an imaging frame F1 illustrating the imaging range obtained by the imaging range detector 404, a coordinate position calculator 406 which obtains coordinates of each position of an image imaged by the suspended load-monitoring camera 30, and a correction section 407 which corrects a position of a limit performance line according to a height of an object.

In Embodiment 2, the maximum operation radius calculator 401 obtains the maximum operation radius in an actual load based on the actual load and the projection amount of each of the outriggers 12, 13, the limit performance line calculator 402 obtains the limit performance line R1 illustrating the range of the maximum operation radius illustrated in FIG. 5, and the graphic image generator 403 generates a graphic image Rg illustrating the limit performance line R1 with the rotation axis O1 of the crane 10 as an original point, and displays the graphic image Rg on a left side screen 133Aa of the screen 133A, and displays an image Ga imaged by the suspended load-monitoring camera 30 on a right side screen 133Ab of the screen 133A.

The image range detector 404 obtains a range which is imaged by the suspended load-monitoring camera 30, and overlaps an imaging frame F1 illustrating the position of imaged range with the graphic image Rg to be displayed on the screen 133A.

The limit performance line position detector 405 obtains a position of a limit performance line R1*a* in the imaging frame F1, and overlaps the limit performance line R1*a* with the position of the image Ga obtained by the coordinate position detector 406 corresponding to the position of the limit performance line R1*a* to be displayed.

According to Embodiment 2, it can be confirmed which range in the limit performance line R1 is imaged, and it can be estimated whether or not the limit performance line R1 is exceeded in an expected rotation position before rotating the extensible boom 16.

Figure 6:
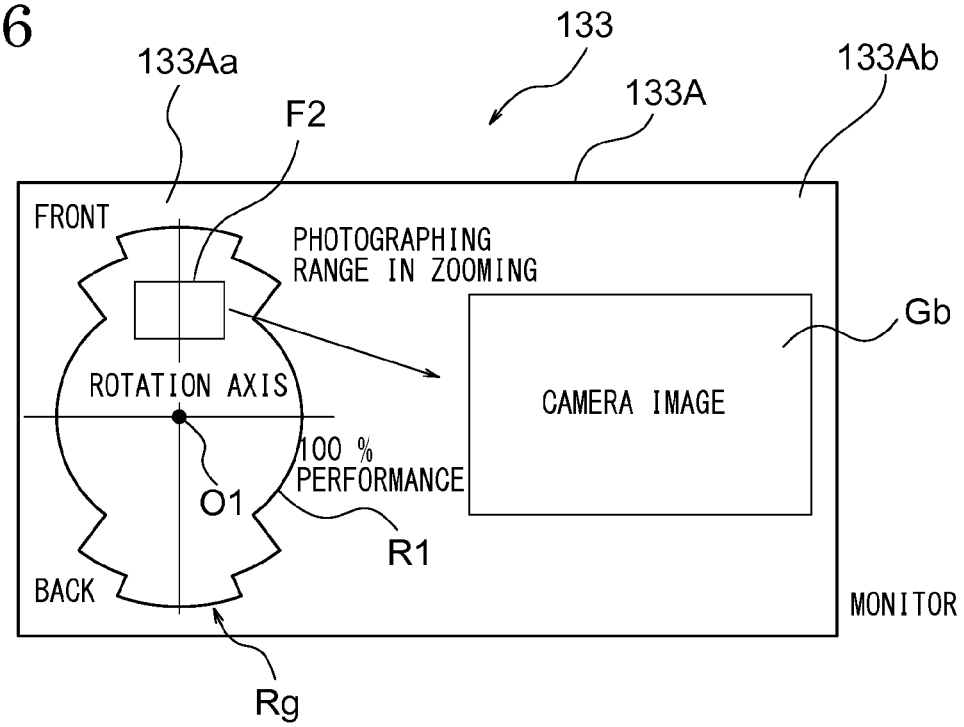
FIG. 6 is a view illustrating another example of a screen of a monitor according to Embodiment 2.

FIG. 6 illustrates a case in which the imaging area of the suspended load-monitoring camera 30, i.e., a photographing frame F2 is inside the limit performance line R1. In this state, the limit performance line R1 is not displayed on an image Gb imaged by the suspended load-monitoring camera 30.

Figure 7:
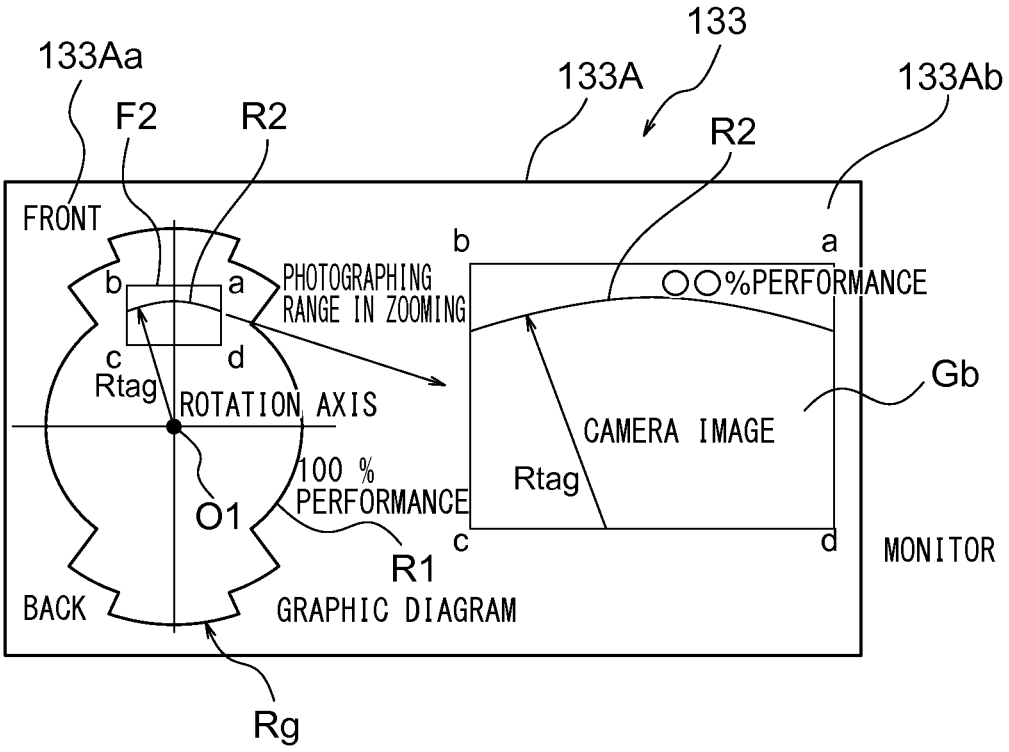
FIG. 7 is a view illustrating a display method of another example of a screen of a monitor according to Embodiment 2.

In this case, as illustrated in FIG. 7, the performance line arithmetic part 400 displays the operation radius (approximately maximum operation radius), which can be displayed in the image Gb, on the image Gb as a performance line R2, and displays the load ratio of the performance line R2 on the image Gb.

Figure 8:
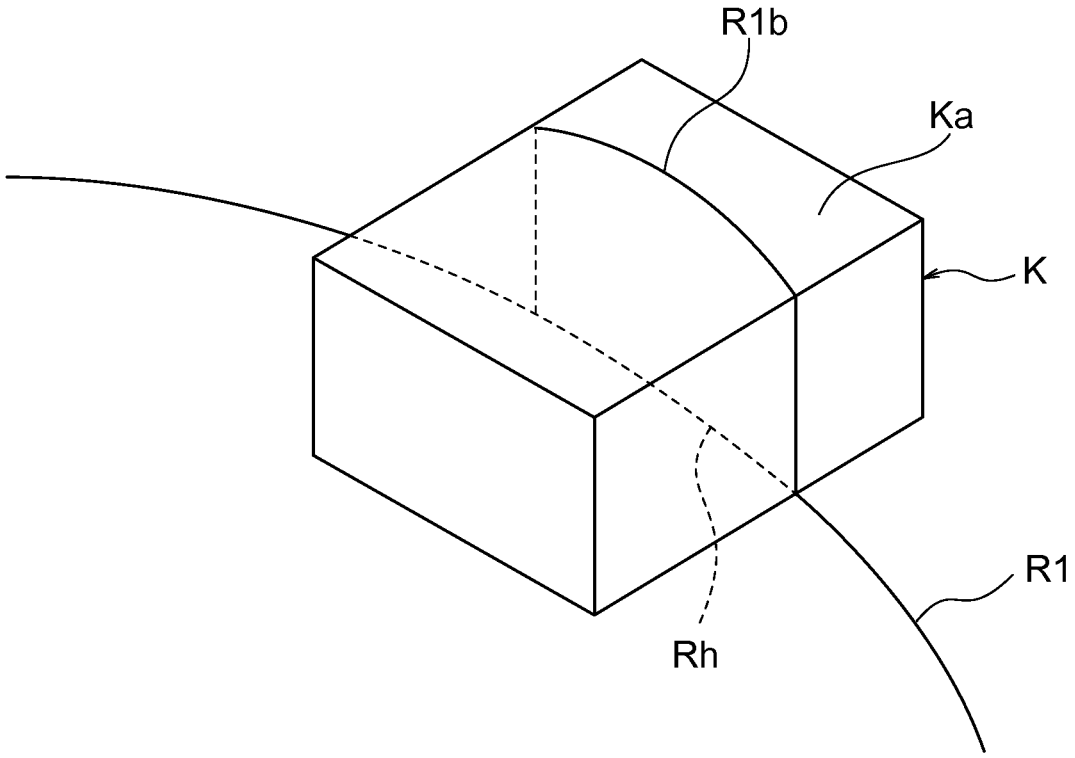
FIG. 8 is a view illustrating a relationship between a limit performance line and a structure.

FIG. 8 illustrates a case in which a structure K is located in the position on the limit performance line R1. Reference number R1*b* is a line obtained by providing the limit performance line R1 on a top face Ka of the structure K.

Figure 9A:
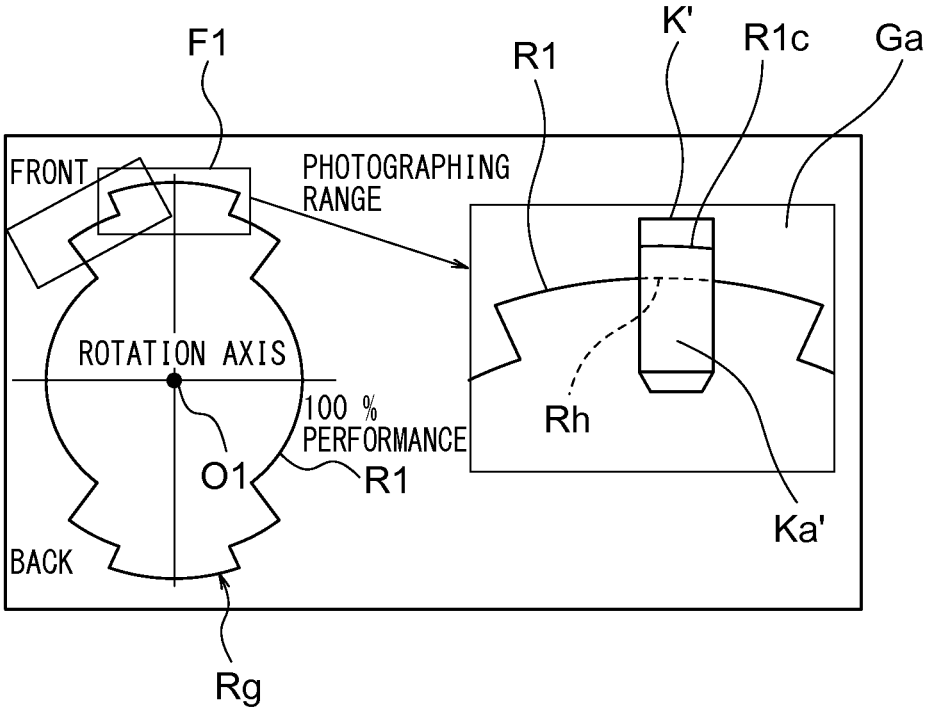
FIG. 9A is a view illustrating a screen displaying a corrected limit performance line on the structure.
Figure 9B:
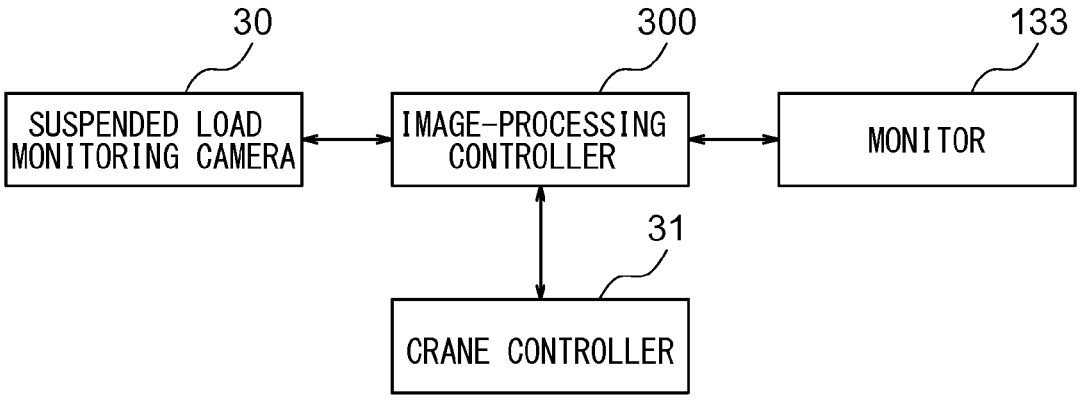
FIG. 9B is a block diagram of a control system illustrating a constitution of a performance line display unit of Embodiment 2.
Figure 9C:
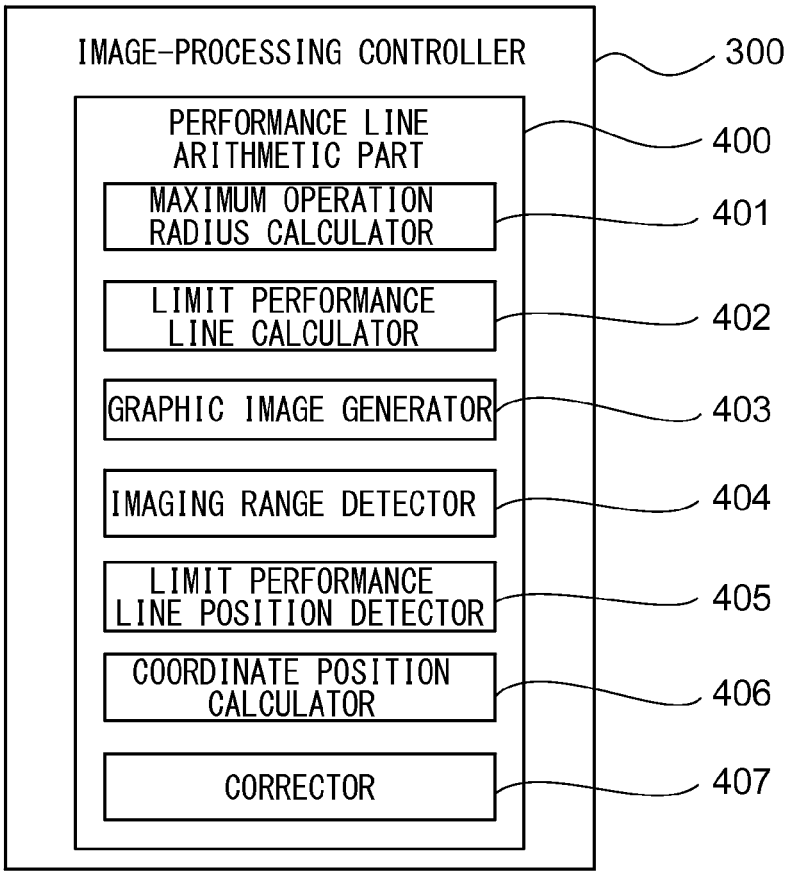
FIG. 9C is a block diagram illustrating a constitution of an image-processing controller illustrated in FIG. 9A.

On the other hand, if the structure K is imaged by the suspended load-monitoring camera 30, and a structure image K' is displayed on the image Ga as illustrated in FIG. 9A, a limit performance line Rh is displayed on a top face Ka' of the structure image K' as illustrated by a dotted line. However, the position where the limit performance line Rh is displayed illustrates the position of the bottom surface of the structure K as illustrated in FIG. 8, and is shifted by the height of the structure K from the position R1*b* illustrating the actual limit performance line.

In this case, in this embodiment, the correction section 407 corrects the position of the limit performance line Rh by the height of the structure K, and displays a limit performance line R1*c* in the position illustrated by the solid line. This correction is performed to separate from the rotation axis position as the height of the structure K is increased.

When the structure K is lower than the ground, the correction becomes opposite according to the depth.

As described above, since the position of the limit performance line Rh is corrected by the height or depth of the structure K to be displayed, the positions of the limit performance lines R1, Rh can be accurately confirmed regardless of the height or depth of the structure K.

In addition, the height of the structure K is obtained by scanning the image area with a laser using a laser distance sensor attached to the leading end of the boom or by using a stereo camera. The above correction is performed from these heights in the same manner as in a case in which the structure is deep.

Embodiment 3

Figure 10A:
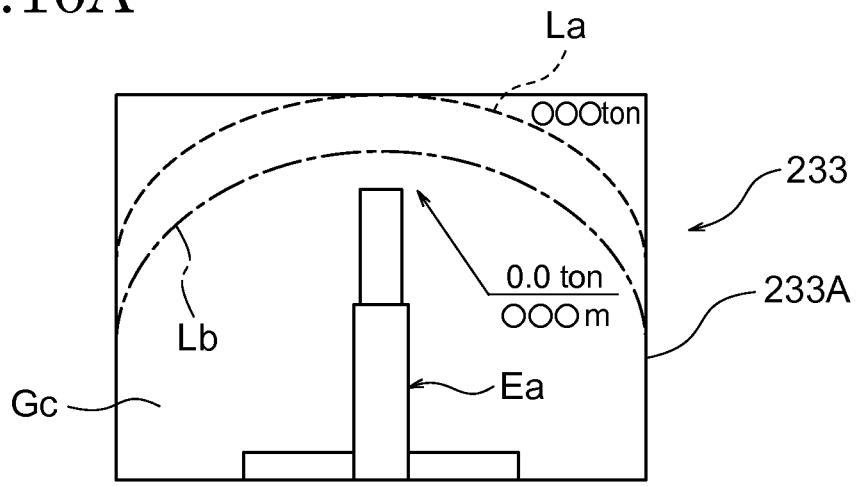
FIG. 10A is a view illustrating a screen of a monitor according to Embodiment 3 when a load is not suspended.
Figure 10B:
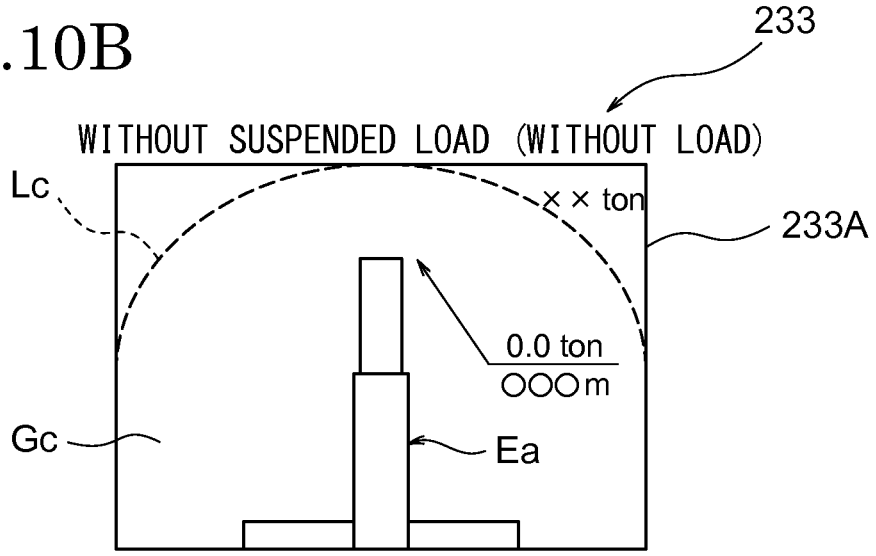
FIG. 10B is a view illustrating another example of a screen of a monitor according to Embodiment 3 when a load is not suspended.

FIGS. 10A, 10B are views each illustrating a screen 233A of a monitor 233 according to Embodiment 3. In Embodiment 3, a graphic image Ea illustrating a boom is overlapped with an image Gc photographed by the suspended load-monitoring camera 30 to be displayed on the screen 233A of the monitor 233.

[When a Load is not Suspended]

When a load is not suspended, as illustrated in FIG. 10A, a limit performance line La illustrating an area of a maximum operation radius in which the extensible boom 16 can move with the present length, the maximum load which can be suspended in the maximum operation radius, and a 90% performance line Lb illustrating a 90% load ratio relative to the maximum suspended load are overlapped with the image Gc to be displayed. "00 ton" and the present length of the extensible boom 16 are displayed on the screen 233A since the load is not suspended.

The load movable area can be confirmed by the screen 233A without suspending a load.

When the maximum operation radius can not be displayed on the screen 233A of the monitor 233, namely, when the maximum operation radius is located outside the image Gc, as illustrated in FIG. 10B, the maximum operation radius which can be displayed in the image Gc, the performance line Lc of the maximum operation radius and the maximum load which can be suspended in the maximum operation radius are displayed.

The condition of the performance line Lc of the load can be confirmed before suspending a load because the performance line Lc is displayed even if the performance line La is not displayed on the screen 233A.

[When a Load is Suspended]

Figure 11A:
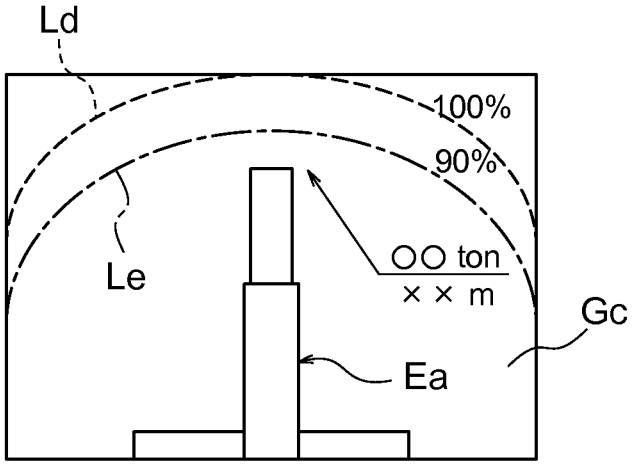
FIG. 11A is a view illustrating a screen of a monitor according to Embodiment 3 when a load is suspended.

When a load is suspended, as illustrated in FIG. 11A, the maximum operation radius (100% limit performance line) which can be moved with the present length of the extensible boom 16 and a 90% performance line Le are overlapped with the image Gc to be displayed. The actual suspended load and the present length of the extensible boom 16 are also displayed.

Figure 11B:
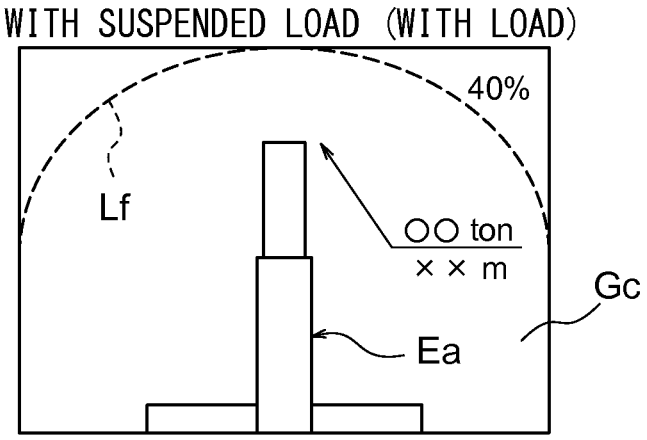
FIG. 11B is a view illustrating another example of a screen of a monitor according to Embodiment 3 when a load is suspended.

When a 100% limit performance line Ld can not be displayed on the image Gc, as illustrated in FIG. 11B, the maximum operation radius which can be displayed in the image Gc, a performance line Lf illustrating the area of the maximum operation radius and the load ratio of the maximum operation radius are displayed.

Embodiment 3 can obtain the effects similar to those in Embodiment 1.

In this embodiment, the length of the graphic image Ea illustrating a boom is fixed, but the length of the graphic image Ea can be changed according to the length of the actual extensible boom 16.

In the above embodiments, the positions of the performance lines and the limit performance lines relative to a crane are calculated by the image-processing controller 32, but they can also be calculated by the crane controller 31.

Although the embodiments of the present invention have been described above, the present invention is not limited thereto. It should be appreciated that variations may be made in the embodiments described by persons skilled in the art without departing from the scope of the present invention.

What is claimed is:

1. A performance line display unit, comprising:

an imaging device which is attached in proximity to a leading end of an extensible boom provided on a rotation platform rotatably placed on a vehicle of a crane;

a display configured to display an image imaged by the imaging device, the image is imaged from above toward a hook block with the imaging device attached in proximity to the leading end of the extensible boom; and a performance line arithmetic part configured to obtain a first performance line regarding a suspended load maximum performance of a crane, wherein the performance line arithmetic part includes a coordinate position calculator configured to match a coordinate position on a real space and each position of the image by the imaging device, the performance line arithmetic part is configured to bring a position of the obtained first performance line in line with the coordinate position obtained by the coordinate position calculator, and overlap the first performance line with the image to be displayed on the display, so as to display an actual position of the first performance line on an actual image, and the performance line arithmetic part is configured to obtain a second performance line having a load rate lower than that of the first performance line, and to display the obtained second performance line on the image of the display together with the first performance line.

2. The performance line display unit according to claim 1, wherein the performance line arithmetic part includes a maximum operation radius calculator configured to calculate a maximum operation radius in which an actual suspend load can be moved with a rotation axis of the boom as a center when the crane suspends a load and a limit performance line calculator configured to obtain a curved line illustrating a range of the maximum operation radius calculated by the maximum operation radius calculator as a limit performance line, and the performance line arithmetic part is configured to display the limit performance line obtained by the limit performance line calculator on the display as the first performance line.

3. The performance line display unit according to claim 1, wherein the performance line arithmetic part includes a maximum operation radius calculator configured to calculate a maximum operation radius in which a suspended load in a present length of the boom can be moved with a rotation axis of the boom as a center when the crane does not suspend a load and a curved line calculator configured to obtain a curved line illustrating a range of the maximum operation radius calculated by the maximum operation radius calculator as a performance line, and the performance line arithmetic part is configured to display the performance line obtained by the curved line calculator on the display as the first performance line.

4. The performance line display unit according to claim 1, further comprising:

a virtual load input section configured to input a virtual load when the crane does not suspend a load, wherein the performance line arithmetic part includes a maximum radius calculator configured to calculate a maximum operation radius in which a virtual suspend load input by the virtual load input section can be moved and a limit performance line calculator configured to obtain a limit performance line illustrating an area of the maximum operation radius calculated by the maximum operation radius calculator, and the performance line arithmetic part is configured to display the limit performance line obtained by the limit performance line calculator on the display as the first performance line.

5. The performance line display unit according to claim 1, wherein when a position of the first performance line is outside an image displayed on the display, the performance line arithmetic part is configured to obtain a third performance line having a load rate lower than that of the second performance line in an operation radius which can be displayed in the display, and to display the third performance line on the display.

6. The performance line display unit according to claim 1, wherein when the crane does not suspend a load, and a position of the first performance line is outside the image displayed on the display, the performance line arithmetic part is configured to obtain a curved line illustrating a position of an operation radius which can be displayed on the display and a maximum load which can be suspended in the operation radius to be displayed on the display.

7. The performance line display unit according to claim 1, further comprising a correction section configured to correct a display position of a performance line overlapped with the image according to a height of an object when the object having the height different from a height of the ground is in an imaging range of the imaging device.

8. A performance line display unit, comprising:

an imaging device which is attached near a leading end of an extensible boom provided on a rotation platform rotatably placed on a vehicle of a crane;

a display device including a display configured to display a graphic image illustrating a limit performance line with a rotation center of the crane as an original point;

an imaging range detector configured to obtain an imaging range of the imaging device; and a limit performance line detector configured to obtain a position of the limit performance line based at least on a load to be carried by the extensible boom, wherein the imaging range detector is configured to display an imaging frame illustrating the obtained imaging range on the graphic image, the display device is configured to display the image in the imaging frame illustrating the imaging range by the imaging device and the graphic image on the display, the limit performance line position detector is configured to obtain the position of the limit performance line in the imaging frame displayed on the graphic image, and to display the limit performance line in a position corresponding to the obtained position on the image by the imaging device.

* * * * *